US010457458B1

(12) United States Patent
Podbelsek et al.

(10) Patent No.: US 10,457,458 B1
(45) Date of Patent: Oct. 29, 2019

(54) FLIP WRAP

(71) Applicants: Alix Rose Podbelsek, Highland Park, IL (US); Jake Podbelsek, Highland Park, IL (US)

(72) Inventors: Alix Rose Podbelsek, Highland Park, IL (US); Jake Podbelsek, Highland Park, IL (US)

( * ) Notice: Subject to any disclaimer, the term of this patent is extended or adjusted under 35 U.S.C. 154(b) by 63 days.

(21) Appl. No.: 15/975,595

(22) Filed: May 9, 2018

Related U.S. Application Data

(60) Provisional application No. 62/504,341, filed on May 10, 2017.

(51) Int. Cl.

| | |
|---|---|
| ***B65D 65/22*** | (2006.01) |
| ***B65D 75/14*** | (2006.01) |
| ***B65D 75/52*** | (2006.01) |
| ***B65D 75/00*** | (2006.01) |
| ***B65B 67/08*** | (2006.01) |
| ***B65D 85/34*** | (2006.01) |

(52) U.S. Cl.
CPC ..... *B65D 75/14* (2013.01); *B65B 67/085* (2013.01); *B65D 65/22* (2013.01); *B65D 75/006* (2013.01); *B65D 75/525* (2013.01); *B65D 85/34* (2013.01); *B65H 2701/1752* (2013.01); *B65H 2701/53* (2013.01); *Y10T 428/24017* (2015.01)

(58) Field of Classification Search
CPC ..... Y10T 428/24017; B65D 65/22; B65D 75/14; B65D 75/006; B65D 75/525; B65D 85/67; B65B 67/085; B65H 2701/1752
See application file for complete search history.

(56) References Cited

U.S. PATENT DOCUMENTS 5,308,690 A * 5/1994 Butcher, Jr. ..... B32B 7/00 442/16

* cited by examiner

*Primary Examiner* — Alexander S Thomas
(74) *Attorney, Agent, or Firm* — Lesley A. Wallerstein, LLC

(57) ABSTRACT

We disclose a sheet of twist-free cling wrap, comprising opposing multi-ply flaps and opposing thumb tabs. The flaps have concealed integral hooks which connect sheets to one another in a series. Rigid extensions to the sheet lodge beneath a dispensing slit to dispense one sheet at a time.

9 Claims, 10 Drawing Sheets

FLIP WRAP

CROSS-REFERENCE TO RELATED APPLICATION (not applicable)

STATEMENT REGARDING FEDERALLY SPONSORED RESEARCH OR DEVELOPMENT (not applicable)

NAMES OF PARTIES TO A JOINT RESEARCH AGREEMENT (not applicable)

REFERENCE TO SEQUENCE LISTING, A TABLE OR A COMPUTER PROGRAM LISTING COMPACT DISC APPENDIX (not applicable)

FIELD OF THE INVENTION

This invention relates to twist-free sheets of cling wrap.

BACKGROUND OF THE INVENTION

Snack and food storage bags and plastic food wrap are not new. Fold-over and easy-seal plastic snack and storage bags come in a variety of sizes, convenient for keeping a sandwich fresh or for holding a bag of chips for lunch. They are easy to work with, can be used to store anything from warm cookies to a bunch of cold grapes, and they are generally reusable (although we typically toss them when we are done with whatever food was inside). Other food storage bags can be vacuum sealed via a special appliance, or simply closed with twist tie Unfortunately, snack and food storage bags are not that useful when we want to cover a bowl of cut-up fruit or a chunk of cake or the leftovers in a casserole dish. Whether it's because the casserole contains liquid or we just want to keep it in the dish for ease of reheating. Perhaps the dish is simply too clumsy to handle or we are too busy to transfer it out of the dish. Snack and food storage bags, even one-gallon size, do not solve all of our food preservation issues.

Lidded glass and rigid plastic containers are another useful option. They are washable, reusable, and come in a variety of sizes to hold just the right amount of leftovers. However, because there are two matching parts to keep, it can become increasingly difficult if not eventually impossible to find the right lid. Sometimes the lid has permanently gone missing or the drawer where all of the storage containers are kept is a mess of mismatched bottoms and tops. It is difficult to get the right size and shape match. And let alone having limited room to conveniently store all these containers, some people just do not want to have to clean more containers—often choosing to not transfer leftovers to a new container or containers.

Aluminum foil is yet another solution. You can dispense exactly the amount you need, mold it around openings of any shape, and it is recyclable. However, you cannot see through it to know what it covers, not without removing it. Nor does it cling, leaving gaps where air seeps in and the foil slides in place. A casserole dish covered with aluminum foil is likely to allow its aroma to blend and permeate with all the other food in the refrigerator. For these reasons, aluminum foil is generally better for wrapping separate small food items completely, and for use as a tent when reheating a casserole or as a make-shift pan, such as for warming bread in the oven. This leaves plastic food wrap.

Plastic food wrap, sometimes known as cling film, cling wrap, or stretch wrap, is amazingly useful and solves many of these problems. You can pull off the length you want, it clings tightly to glass, glazed ceramic and metal serving dishes of all sizes and shapes. You can see through it. It generally keeps food fresh and odor-free. A roll of plastic food wrap stores easily in a small drawer, and it makes an excellent ad hoc lid for just about any size bowl or dish. The very clinginess that makes plastic wrap ideal for forming an airtight seal on dishware is the same one that makes the wrap cling to itself. It is impossible to separate sheets of cling wrap stuck to itself, and nearly impossible to find the leading edge to pull off a roll. This creates enormous waste. In our experience, it is almost impossible to unroll, cleanly cut, and effortlessly apply a right-sized sheet of plastic food wrap without accidentally twisting it into a self-clinging, tangled ball. What is needed at home, grocery stores and restaurants is an easy and twist-free way to dispense a sheet of cling wrap.

BRIEF SUMMARY OF THE INVENTION

To solve this problem, we created a sheet of cling wrap that will not twist. The sheet can be several different shapes. Preferably, the sheet is a rectangle, but it can also be a square, an oval or a circle. Regardless of shape, each sheet comprises a 1-ply body with a top, a bottom, a left side, a right side, a length from the top to the bottom, and a width from the left side to the right side. The sheet further comprises a 3-ply flap seamed to each of the top and the bottom, a spine embedded into, running the length of and projecting beyond the body-flap seam, a 2-ply thumb tab fused to a midpoint of each of the right side and the left side. The thumb tabs do not touch the flaps. Multiple sheets are connected, rolled around a core. The roll of sheets is stored in, and dispensed through a slit in, a box. The length of the slit is smaller than the width of the sheet with projecting spine. The body, flaps, and thumb tab may be plain or colored, incorporate interesting patterns, textures, decorative elements, and shapes and dimensions. The flaps may be round or oval shaped, square or rectangular.

The body comprises a single ply film of stretchy, clingy material. Preferably, the material is polyvinylidene chloride (PVDC) or low-density polyethylene (LDPE). We contemplate alternative films as well, such as cellulose, silicone or other non-plastics that can be treated to cling to glass, ceramic or metal. Each flap comprises a three-ply rigid flap extending from the sheet, along substantially the entire top and bottom edges. The bottom ply extends from and is continuous with the sheet. It is the same cling film. Preferably, the second, center ply is a cling-free film, one which does not cling to glass, ceramic, metal, or to itself, such as polyethylene terephthalate ethylene (PETE), high density polyethylene (HDPE), polypropylene (PP) or linear low density polyethylene (LLDPE). The center ply may also comprise other plastics, cellulose or silicone or other such cling-free film. The top ply is a second layer of cling film. In this way, the cling-free film is sandwiched between, and does not cling to, the cling film. The three plies are sealed only in a line where they join the sheet, creating the flap.

The spine has a central, flexible, segment collinear with and fused into the body-flap seam, and a terminal, rigid segment joined to each side of the central segment. The rigid segments of the spine project beyond the width of the body coplanar with and perpendicular to the width of the body and the flap. The center ply of the top flap and the bottom flap further comprises hooks cut therein. The hooks project at an angle from the plane of the center ply.

The flexible central segment comprises polyvinylidene chloride (PVDC) or low-density polyethylene (LDPE). The rigid terminal segments joined thereto comprise a thicker strip of these same materials, at least four times thicker than the flexible central segment.

Each hook comprises a letter U cut into the center ply. Each flap has three such U's in a row centered vertically and horizontally. In the top flap, the U is right side up. In the bottom flap, the U is upside down. The upside down U's of the bottom flap of a first sheet interlock with the right side up U's of the top flap of a second sheet. Only the center ply interlocks. The interlocking joint is covered by the top and the bottom ply of cling wrap, both on the top and the bottom. These additional layers further protect the joint from accidentally coming loose. It requires some force to separate the interlock. Additional sheets are connected in series in the same way, one to the next, to the next and so forth. Multiple individual sheets are connected this way and rolled top to bottom onto a rigid core. This roll of sheets is contained within a box and dispensed, one at a time, through a slit at a top of the box. The slit is dimensioned to be narrower than the width of the sheet plus terminal segments. When the first sheet is pulled, the terminal segments of the second sheet cannot pass through without applying additional force. Thus the first sheet can be pulled free and separated from the second sheet. The second sheet is retained within the box.

The thumb tabs comprise two plies. The bottom ply is the body of cling film itself. The top ply is a square or rectangle of cling-free film such as polyethylene terephthalate ethylene (PETE), high density polyethylene (HDPE), polypropylene (PP) or linear low density polyethylene (LLDPE) fused onto a midpoint along the length of the body. The thumb tab is flush with the left side and the right side of the body. Preferably, these thumb tabs do not extend the entire length of the left edge or the right edge.

In practice, a top flap of a first sheet is already extending through the dispensing slit. There is at least a second sheet connected to it still beneath the dispensing slit and rolled up inside the box. A person pulls the top flap through the slit with enough force to disengage the hooks. This pulls the second sheet along with it until the terminal ends of the spine of the second sheet lodge beneath the slit. This exposes the top flap of the second sheet for the next use.

With the first sheet still in the air, the person quickly grasps the bottom flap and pulls the sheet taut. He positions the stretched sheet over the opening of a glass, ceramic or metal food container and presses it to seal tight. Thumb tabs can be grasped between a thumb and forefinger for additional stretching in the perpendicular direction.

REFERENCE NUMERALS

Figure 1:
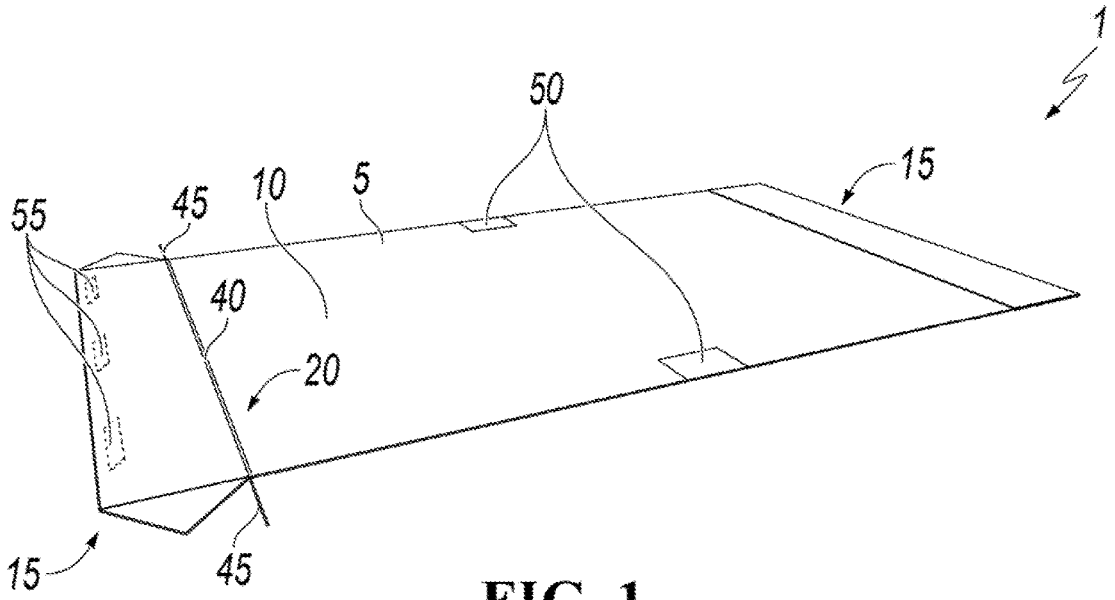
FIG. 1 is a top perspective view of a sheet of flip wrap, shown in a closed configuration
Figure 2:
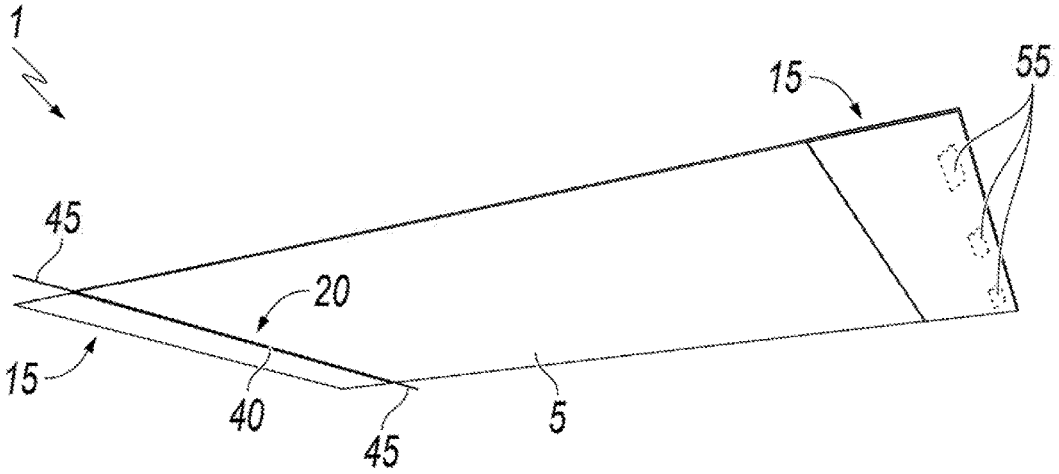
FIG. 2 is a bottom perspective view of a sheet of flip wrap, shown in a closed configuration
Figure 3:
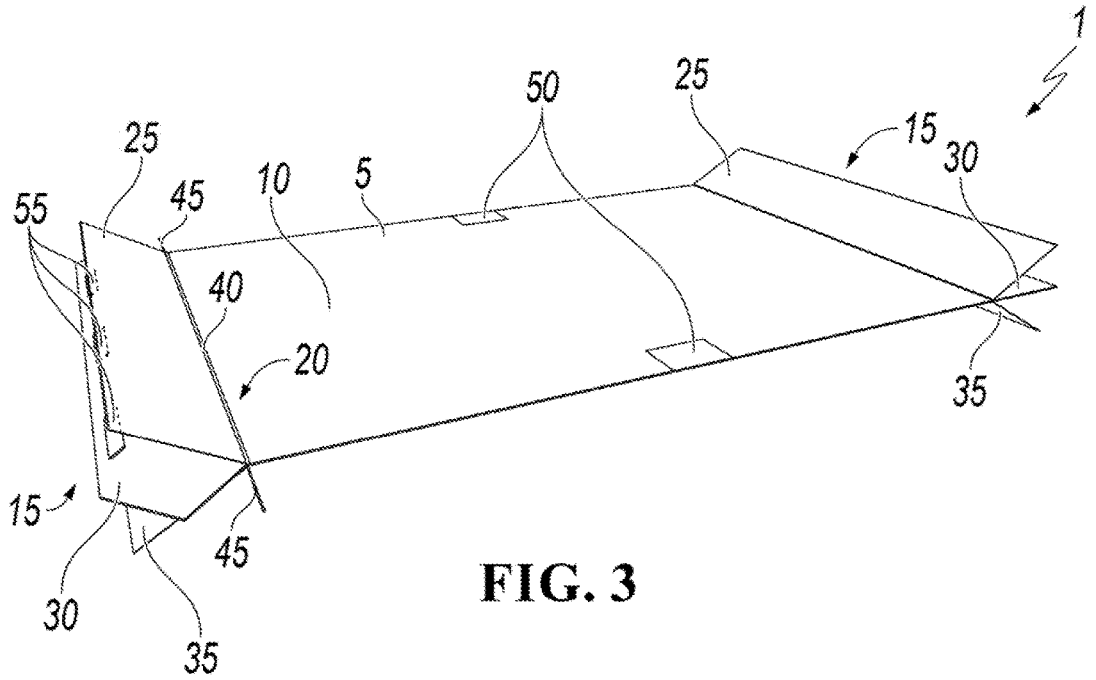
FIG. 3 is a top perspective view of a sheet of flip wrap, shown in an open configuration
Figure 4:
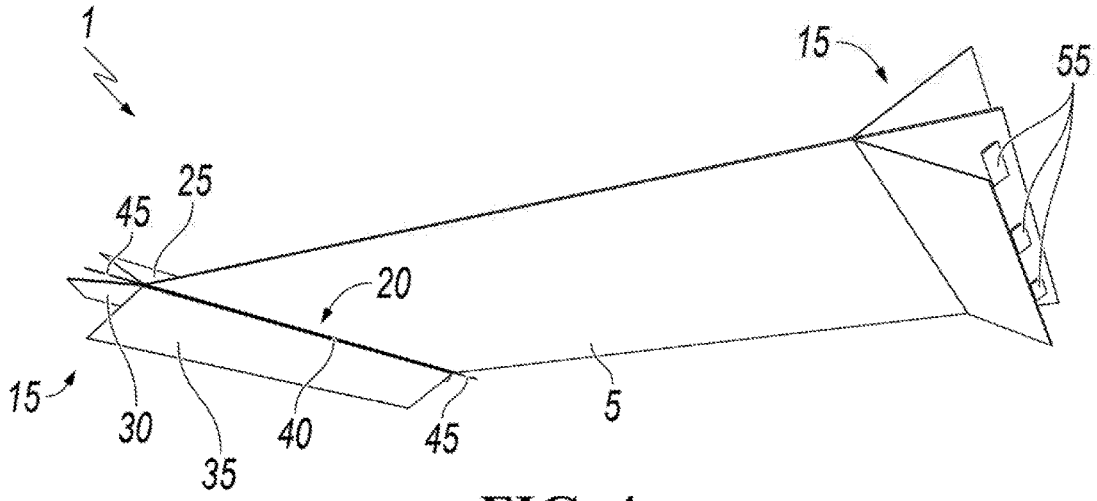
FIG. 4 is a bottom perspective view of a sheet of flip wrap, shown in a closed configuration

1. Flip wrap
5. Body
10. Front of body
15. Flap
20. Spine
25. Top ply of flap
30. Center ply of flap
35. Bottom ply of flap
40. Central segment of spine
45. Terminal segment of spine
50. Thumb tab
55. Hook
60. Roll of individual sheets of flip wrap connected in series
65. Box
70. Dispensing slit

DETAILED DESCRIPTION OF THE INVENTION

FIGS. 1-4 shows an individual sheet of flip wrap 1 in a closed configuration. Preferably, the sheet is rectangular, and this is what we show. However, the reader should keep in mind that the sheet can be another shape as well, including, but not limited to, a square, circle or oval. For convenience and simplicity, we illustrate a rectangle only. The sheet comprises a body 5 of a single ply of cling film. The body has a top, a bottom, a front 10, a back, a left side and a right side. Preferably the cling film comprises polyvinylidene chloride (PVDC) or low-density polyethylene (LDPE). Alternative films can be used as well, such as cellulose, silicone or other non-plastics, as long as they cling to glass, ceramic or metal. Preferably, the body is a rectangle measuring 15 inches long, by 12 inches wide by 0.000354 inches thick. Other dimensions are possible that are within the scope of the invention.

Seamed to the front of the body at both the top and the bottom is a flap 15 comprising three plies. The bottom ply 35 of the flap is actually a continuation of the body, but we measure it separately and identify it as part of the flap. The center ply 30 of the flap is a cling-free film comprising preferably polyethylene terephthalate ethylene (PETE), high density polyethylene (HDPE), polypropylene (PP) or linear low density polyethylene (LLDPE). The center ply may also comprise other plastics, cellulose, or silicone or other such cling-free film. In the illustration, the center ply of the flap is drawn as an elongated hexagon, to easily separate from the top and the bottom plies. However, other shapes can be used and still remain within the scope of the invention. Preferably, the center ply measures approximately 13 inches long by 1¼ inches wide and 0.004 inch thick. The top ply 25 comprises a second layer of cling film, the same as that used in the body, approximately 12 inches long by ½ inch wide and 0.00354 inch thick. This forms a sandwich of cling-free film at both the top and the bottom of the body.

The sandwich is crimped or seamed together by heat to both the top and the bottom of the body. The layers are joined together only in a single line (which can be curved in the case of an oval or a circular body) where the body meets the flap. This leaves the individual plies of the flap free to fold up in a closed configuration, or fold down to an open configuration, revealing the center ply.

Figure 10:
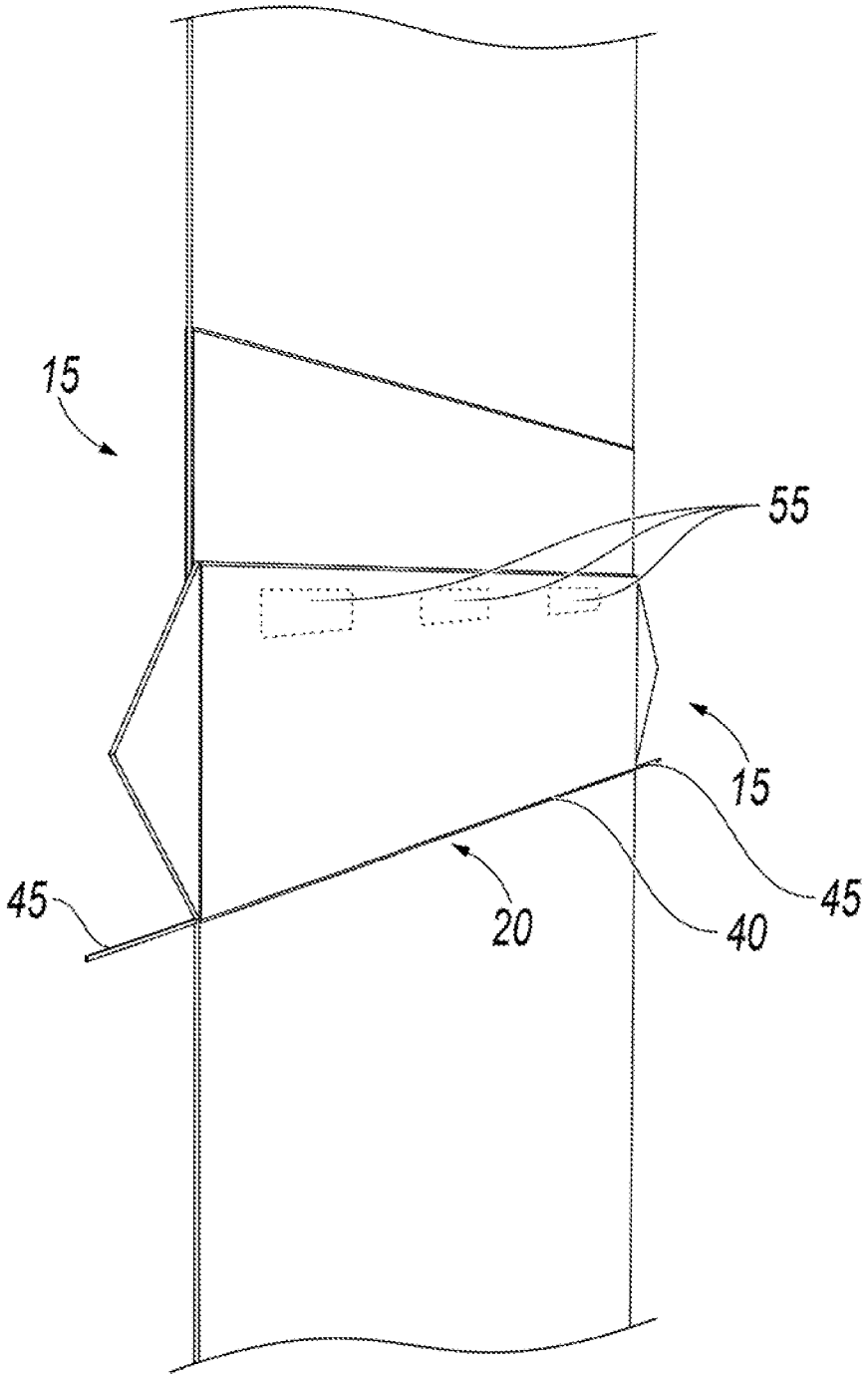
FIG. 10 is an enlarged, perspective view of two sheets of flip wrap connected at the hooks, in series
Figure 11:
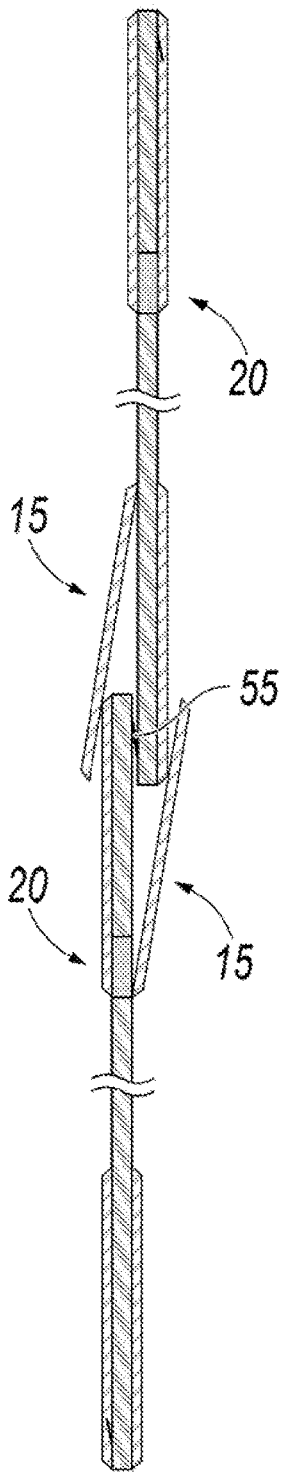
FIG. 11 is an enlarged, side view of two sheets of flip wrap connected at the hooks, in series
Figure 12:
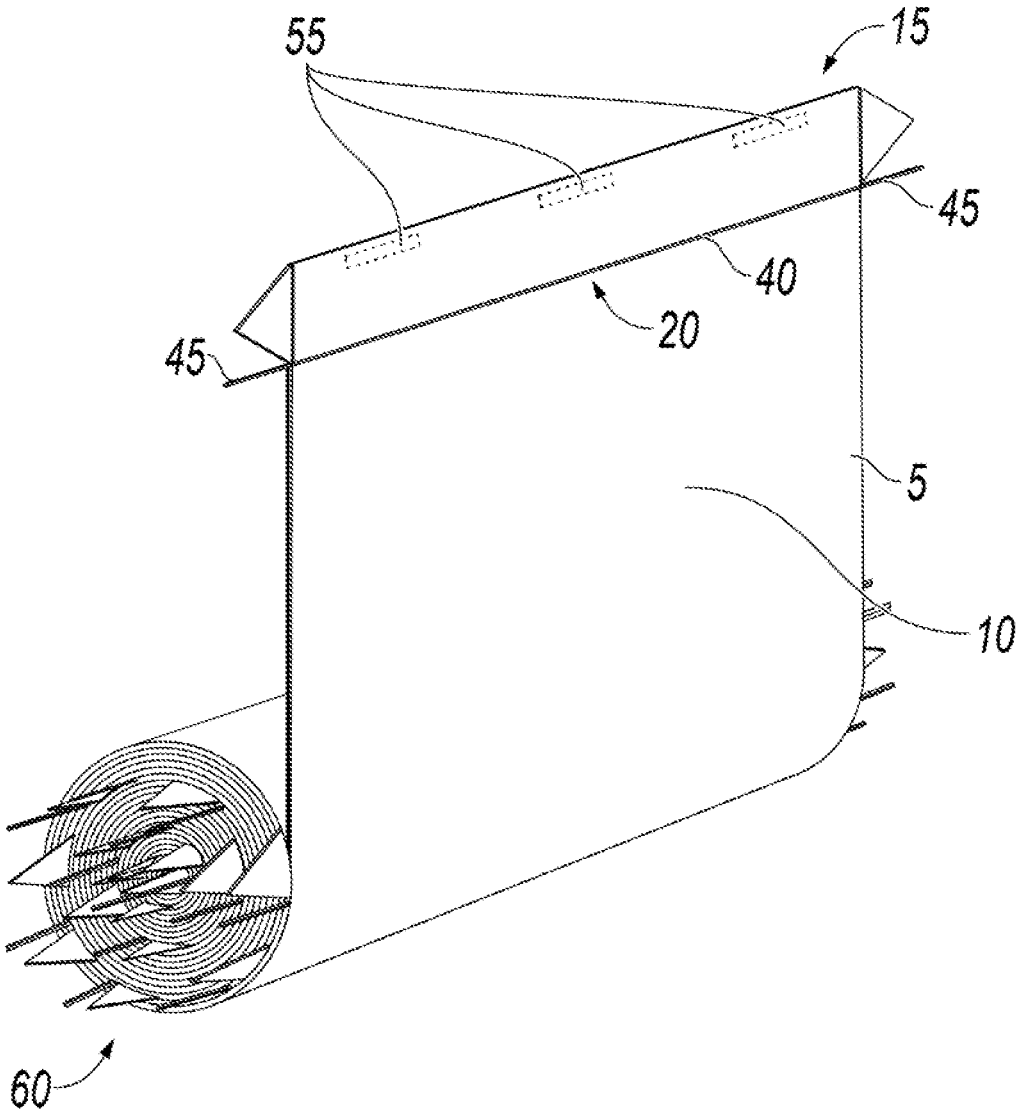
FIG. 12 is a perspective view of a plurality of sheets of flip wrap, connected in series and rolled about a core (not shown)

The center ply of both the top and the bottom flap further comprises functional hooks 55 cut thereinto. These hooks are used to connect sheets together in a series. In the illustration, the hooks are U shaped cuts into the center ply. In practice, the bottom flap hooks of a first sheet interlock with the top flap hooks of a second sheet. Please refer to FIGS. 10 and 11. The joint is concealed with the top and the bottom layers of the flap, which are cling film. Additional sheets can be added in this way, bottom hooks of one sheet to top hooks of another sheet, until a series of a desired length is obtained. Machinery can automate this process. FIG. 12 shows a series of individually connected sheets rolled about a rigid core.

Please note also a spine 20 laid into the body-flap seam line. The spine comprises a central segment 40 and two terminal segments 45 joined to either end of the central segment. Preferably the central segment is a strip of flexible material, preferably polyvinylidene chloride (PVDC) or low-density polyethylene (LDPE), approximately 12 inches long by ⅛ inch wide and 0.004 inch thick. The rigid terminal segments joined thereto comprise strips of polyvinylidene chloride (PVDC) or low-density polyethylene (LDPE) approximately ½ inch long and 0.016 inch thick. The total length of the spine is approximately 13 inches. As with all of the preferred dimensions of this invention, the length, width and thickness can be varied by someone of ordinary skill in the art and still remain within the scope of this invention.

Figure 5:
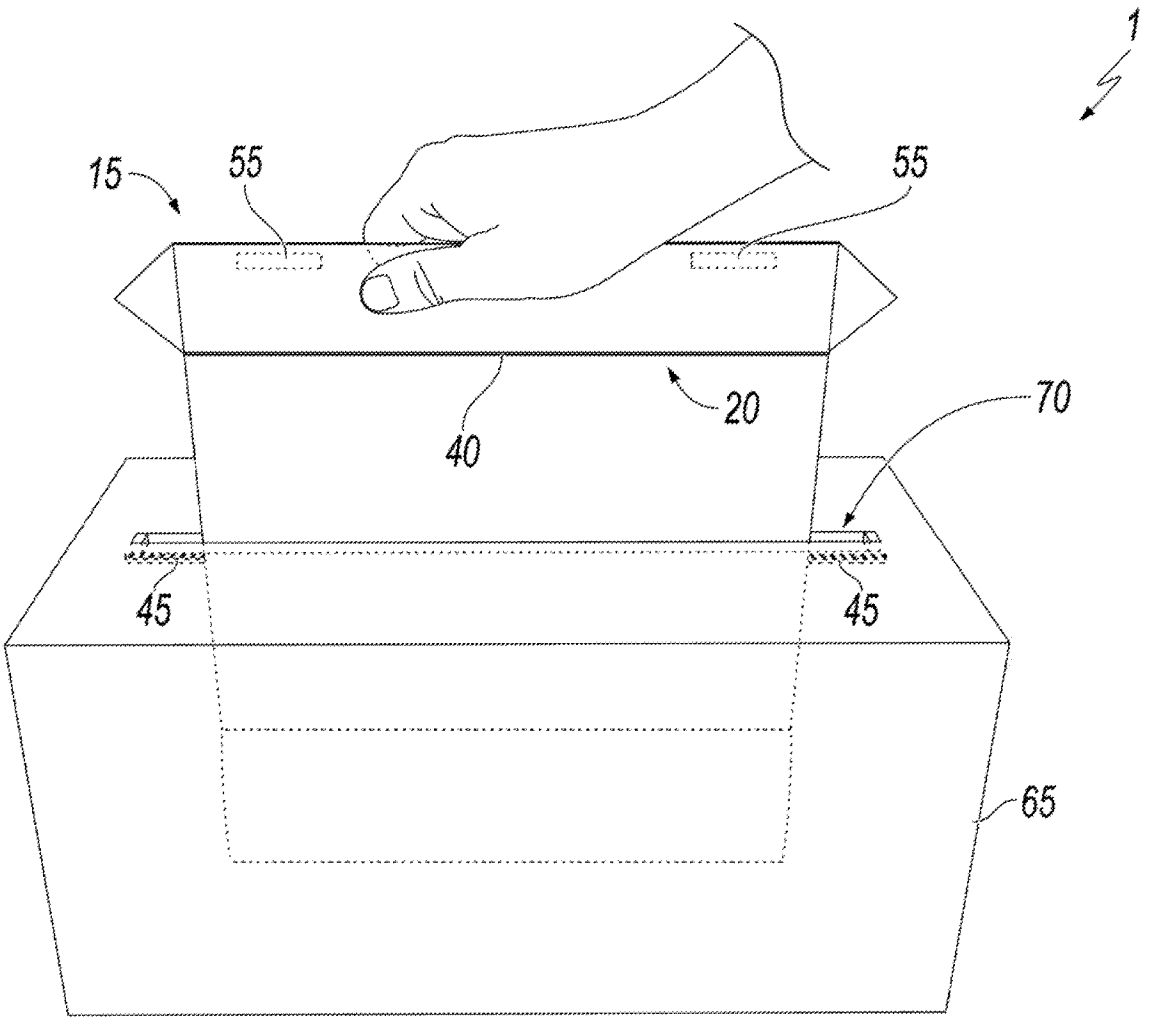
FIG. 5 is a perspective view of a person dispensing a single sheet of flip wrap from a box
Figure 6:
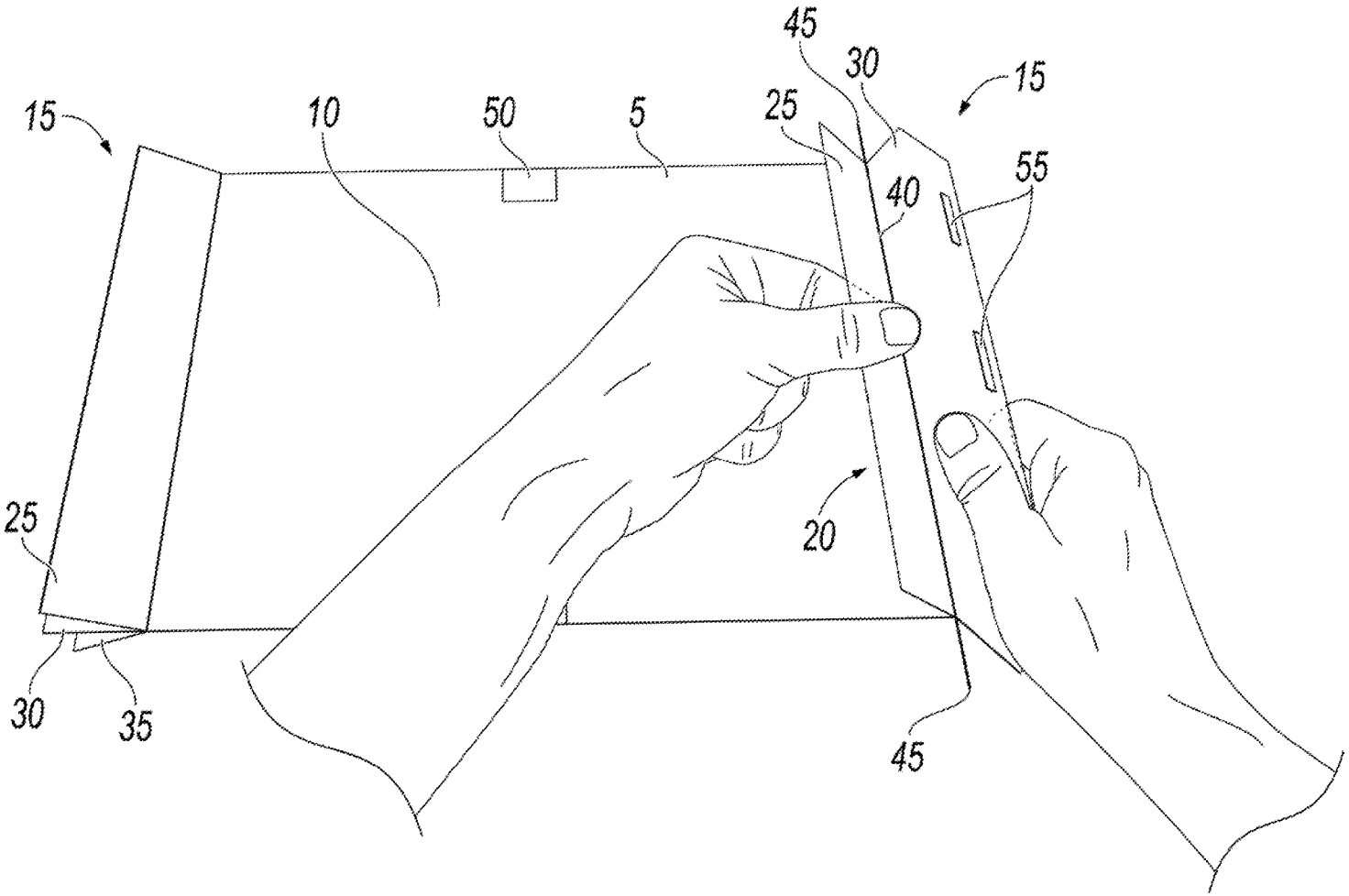
FIG. 6 is a perspective view of a person separating the plies of a top flap of a sheet of flip wrap

The roll of individual sheets 60 can be stored in, and dispensed from, a box 65 with a dispensing slit 70. Please see FIG. 5. The slit is dimensioned to be shorter than the spine. Preferably, the slit is 12 inches across. This is long enough to permit the sheets, but not the terminal ends of the spine, to easily pass through. In FIG. 5, the top flap and body of a first sheet of flip wrap extends outside the dispensing slit. Just beneath the slit, there is a bottom flap joined to the top flap of a second sheet of flip wrap (not explicitly shown). As the person pulls the first sheet with ordinary upward force, he pulls the first flap clean out of the box, but the terminal segments of the spine block the second sheet from being fully dispensed along with it. In this way, only the first such exposed sheet gets dispensed. To dislodge the terminal segments of the spine, the person must pull the top flap with additional upward force.

Figure 7:
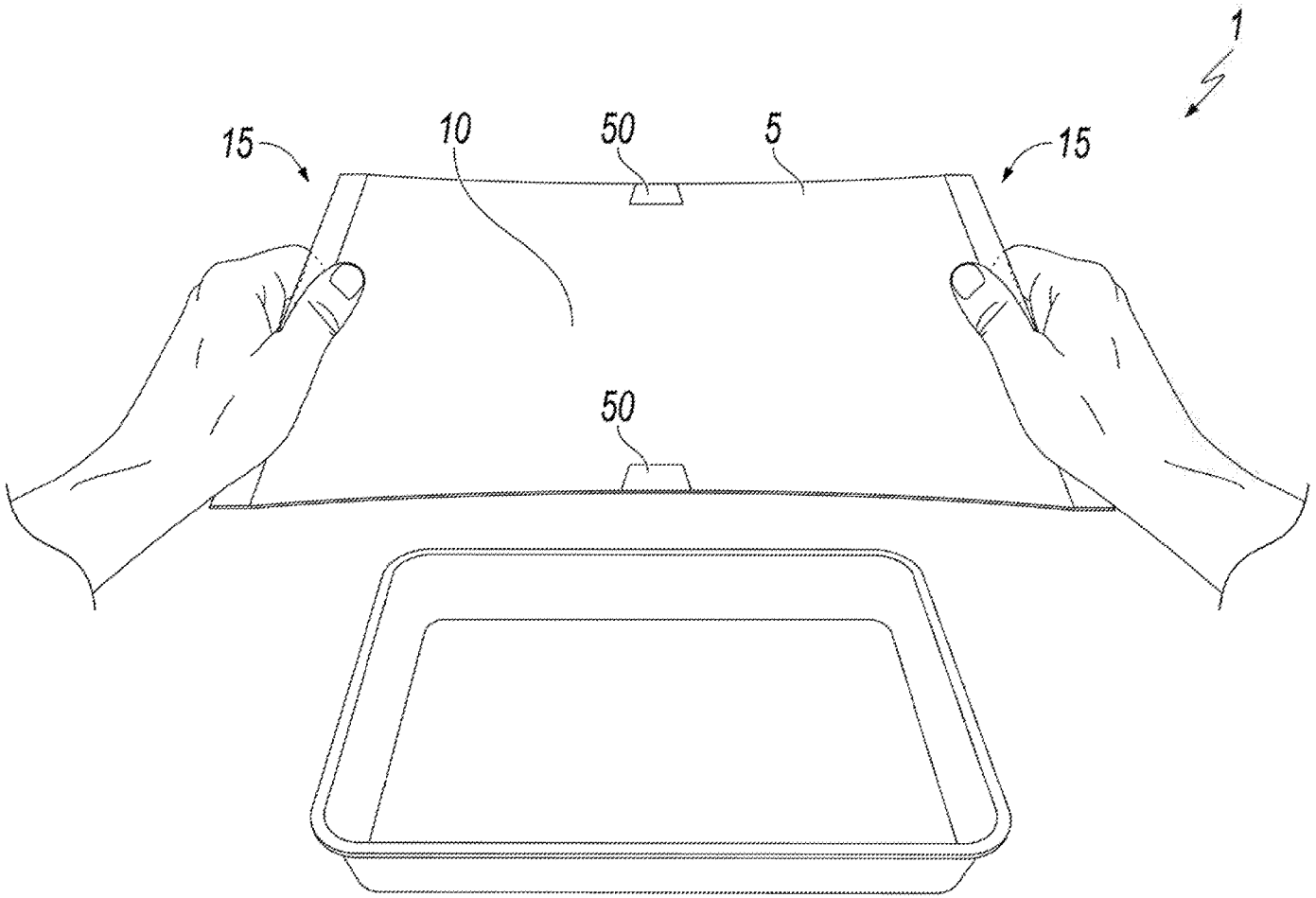
FIG. 7 is a perspective view of a person lengthwise stretching a sheet of flip wrap
Figure 8:
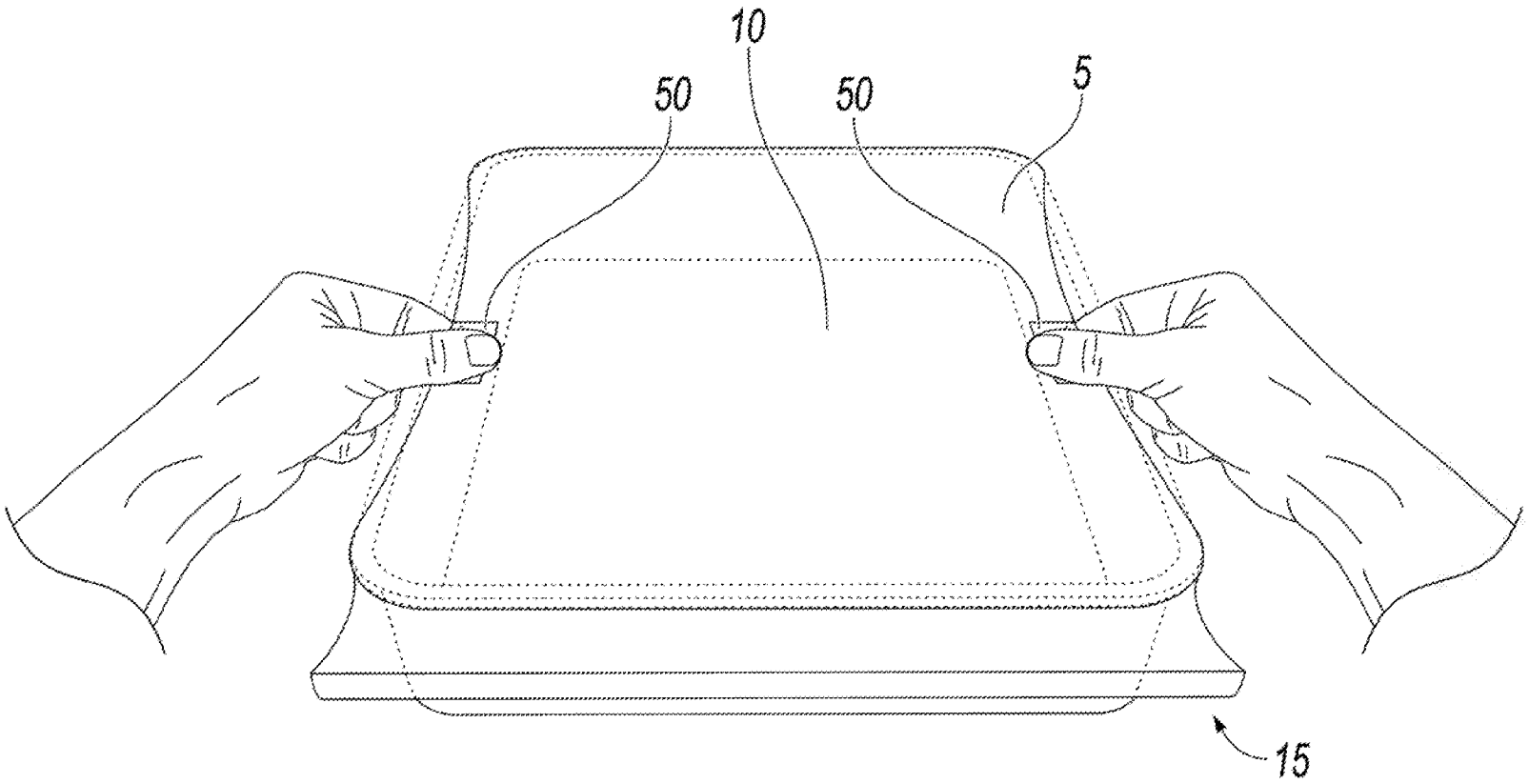
FIG. 8 is a perspective view of a person widthwise stretching a sheet of flip wrap
Figure 9:
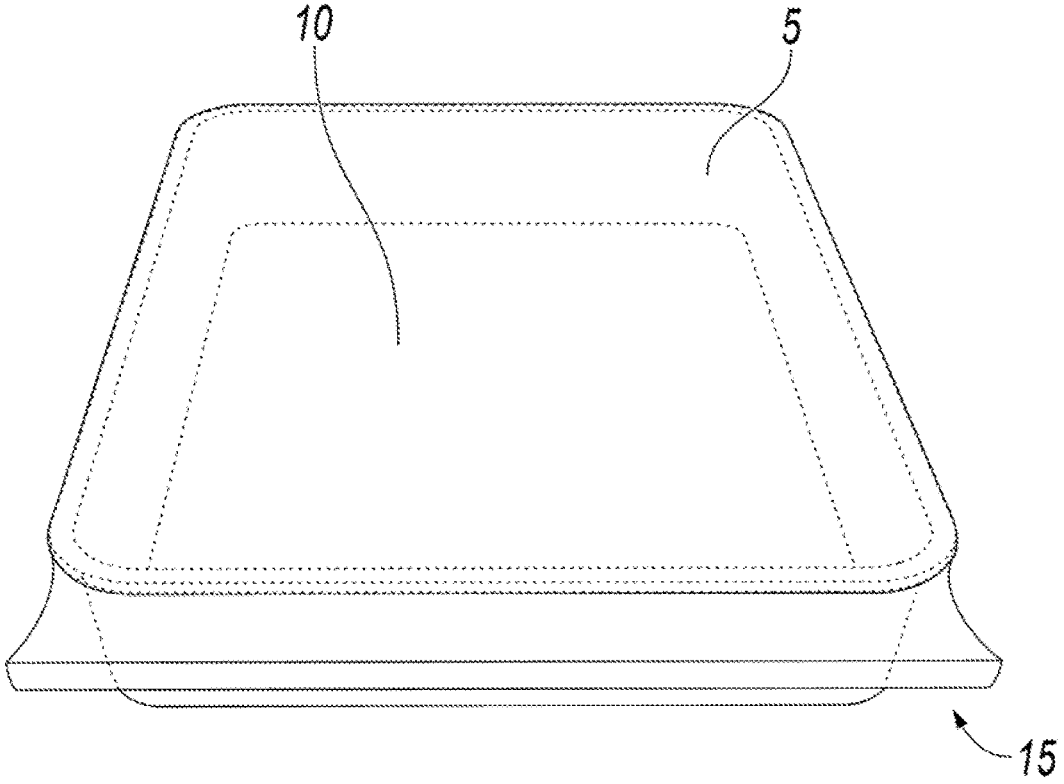
FIG. 9 is a perspective view of a sheet of flip wrap stretched over a casserole dish. The dish is not claimed as part of the invention.

The top flap and its spine, together with the bottom flap, are sufficiently rigid so that a person grasping both can pull them apart and straighten the sheet. As shown in FIG. 7, this allows him time to carry the sheet over to a casserole, or any, dish. He positions the sheet over the dish and applies it where desired. Please see FIG. 8. A thumb tab 50 bonded to each of the front right and front left side of the sheet can be grasped and pulled apart to further straighten the sheet, in the perpendicular direction. The thumb tabs are two ply thick, one ply of which is the body of the sheet. The second ply is a square of flexible and cling-free film approximately 1 inch square by 0.004 inch thick.

We claim:

1. A sheet of twist-free cling wrap, comprising:

A single ply body of cling film having a top, a bottom, a left side and a right side, a front, a back, a length, a three ply flap seamed to each of the top and the bottom of the body, a single ply thumb tab bonded to each of the front left side and the front right side, and a spine fused into, running the length of, and projecting coplanarly beyond, the left side and the right side of the top flap and body seam, wherein the three plies of each flap comprise in this order:

a. a top ply of cling film, b. a center ply of cling-free film, each such center ply further comprising a plurality of hooks cut thereinto and projecting therefrom; and c. a bottom ply of cling film.

2. The sheet of twist-free cling wrap of claim 1, wherein the cling film is selected from the group consisting of polyvinylidene chloride, low-density polyethylene, cellulose, and silicone.

3. The sheet of twist-free cling wrap of claim 1, wherein the cling-free film is selected from the group consisting of polyethylene terephthalate ethylene, high density polyethylene, polypropylene, linear low density polyethylene, cellulose and silicone.

4. The sheet of twist-free cling wrap of claim 1, wherein the spine running the length of the body-flap seam comprises a central segment selected from the group consisting of polyvinylidene chloride, low-density polyethylene, cellulose, and silicone.

5. The sheet of twist-free cling wrap of claim 1, wherein the spine projecting coplanarly beyond the body-flap seam comprises a terminal segment joined to a central segment and is selected from the group consisting of polyvinylidene chloride, low-density polyethylene, cellulose, and silicone.

6. The sheet of twist-free cling wrap of claim 1, wherein the thumb tab comprises polyethylene terephthalate ethylene, high density polyethylene, polypropylene and linear low density polyethylene, cellulose or silicone.

7. The sheet of twist-free cling wrap of claim 6, wherein the thumb tab is dimensioned to be gripped between a thumb and forefinger.

8. A method of connecting a plurality of sheets of twist-free cling wrap into a series, comprising the steps of:

a. Providing a plurality of sheets of the twist-free cling wrap of claim 1;

b. Interlocking the plurality of hooks in the bottom flap of a first sheet of the twist-free cling wrap with a corresponding plurality of hooks in the top flap of a second sheet of the twist-free cling wrap;

c. Interlocking the plurality of hooks in the bottom flap of the second sheet of the twist-free cling wrap with a corresponding plurality of hooks in the top flap of a third sheet of the twist-free cling wrap; and d. Repeating steps (b) and (c) to connect any remaining sheets.

9. A method of dispensing at least one sheet of twist-free cling wrap, comprising the steps of:

a. Providing a series of individual sheets of twist-free cling wrap connected according to the method of claim 8;

b. Rolling the series of individual sheets of twist-free cling wrap around a rigid core;

c. Placing the roll of sheets into a box having a dispensing slit narrower than the length of the spine;

d. Pulling the top flap and the body of a first sheet of the series through the dispensing slit;

e. Lodging the spine of the second sheet of the series beneath the dispensing slit;

f. Separating the first sheet of the series from the box;

g. Leaving the top flap of the second sheet of the second sheet of the series extending outside the dispensing slit; and h. Repeating steps (d)-(g) to dispense additional individual sheets.

* * * * *